United States Patent [19]

Humphrey et al.

[11] Patent Number: 4,628,667

[45] Date of Patent: Dec. 16, 1986

[54] VARIABLE SPEED STRETCH WRAPPER

[75] Inventors: John R. Humphrey; John G. Reed, both of Naples, Fla.

[73] Assignee: International Packaging Machines, Inc., Naples, Fla.

[21] Appl. No.: 235,946

[22] Filed: Feb. 19, 1981

[51] Int. Cl.[4] ..... B65B 11/04

[52] U.S. Cl. ..... 53/399; 53/441; 53/556; 53/587

[58] Field of Search ..... 53/211, 556, 587, 399, 53/441

[56] References Cited

U.S. PATENT DOCUMENTS

| | | | |
|---|---|---|---|
| 2,864,209 | 12/1958 | Balsiger | 51/215 |
| 3,589,102 | 6/1971 | Zelnick | 53/211 X |
| 3,626,654 | 12/1971 | Hoffler | 53/465 X |
| 4,077,179 | 3/1978 | Lancaster | 53/211 |
| 4,248,031 | 2/1981 | Del Pozo | 53/587 X |
| 4,283,903 | 8/1981 | Mayhall | 53/587 |

*Primary Examiner*—John Sipos

*Attorney, Agent, or Firm*—Antonelli, Terry & Wands

[57] ABSTRACT

A wrapping machine for wrapping a load in a unitary package. The load is supported on a rotatable support which can be rotated typically at speeds between 2 and 10 rpm. With the utilization of a variable speed DC motor drive in conjunction with an electronic control circuit, the speed of the support can be infinitely varied. As the support is rotated, a stretchable wrapping material is withdrawn from a rolled up sheet of such material and wrapped around the load due to the rotation of the support. A control mechanism controls the operation of the DC driving motor for causing the support to be rotated a plurality of turns for wrapping the load with the stretchable material being withdrawn from a dispensing mechanism. The control mechanism rotates the support at a first speed during a first portion of the rotatable movement of the support and then at a second slower speed during a subsequent portion of the rotatable movement of the support. The rotation of the support at the second slower speed only occurs during a portion of the last revolution of the support. By the use of such a second slower speed of rotation for the support, it is possible to gradually stop the rotation of the support thereby insuring that the support stops at the proper location in such a manner so as to avoid damage to either the load or the stretchable material being used for wrapping the load.

21 Claims, 5 Drawing Figures

VARIABLE SPEED STRETCH WRAPPER

BACKGROUND OF THE INVENTION

The present invention relates to stretchable wrapping machines for wrapping various size loads with a stretchable wrapping material.

Exemplary of the type of stretchable wrappers in conjunction with which the present invention can be utilized are those types of machines such as broadly disclosed in U.S. Pat. Nos. 3,867,806 and 4,050,221 to Lancaster et al., the subject matters of which are hereby incorporated by reference. However, the minimum tension mechanism utilized during the initiation of the wrapping operation in accordance with these patents to Lancaster et al. need not be utilized in the operation of the wrapping machine of the present invention.

In many of the stretch wrapping machines currently marketed, variable speed turntable drive mechanisms are included as optional equipment. Such variable speed drive mechanisms are included in order to enable a gradual start in acceleration of the motor up to the set speed upon initiation of the wrapping operation. Typically during initiation of the wrapping operation, the wrapping material is merely tucked into the load and hence is not securely attached to the load. Consequently if the initiation of the wrapping operation involved rapid acceleration to the set operating speed, i.e. a rapid start operation, the wrapping material might be pulled out of the load hence necessitating the entire wrapping operation to be restarted. The utilization of such a soft or slow start feature avoids such problems. During such a soft start the tension on the material is normally set at about at least 50% of the full tension during the wrapping operation.

When stopping such wrapping operations in these machines, however, it has been the common practice to simultaneously deactivate the motor and to activate a braking mechanism for immediately stopping the rotation of the support. The utilization of such a braking mechanism is disclosed in U.S. Pat. No. 3,626,654 to Hoffler et al., the subject matter of which is hereby incorporated by reference.

Such a rapid braking of the rotational movement of the support turntable leads to several potential problems. First, there is a tendency for the turntable to overshoot the desired stopping location. This tendency becomes a particularly significant problem where the stretch wrapper is used as part of a conveyor system. In such conveyor systems, proper alignment of the support turntable with the infeed and discharge conveyors is critical. In order to prevent such an overshooting of the turntable, some manufacturers of stretch wrapping machines, such as Infra-Pak, have employed a positive alignment table locking device. Another problem that can occur from the rapid stopping of the support turntable is the effect upon the stretch material and the withdrawal of the stretch material from the dispensing mechanism. The rapid stopping of the support turntable without insuring that the dispensing of the material from the dispensing mechanism is also ceased can cause excess material to be withdrawn from the dispensing mechanism which generates a slack of material thereby reducing the tension on the material and its ability to tightly secure the load being wrapped. Furthermore, the rapid stopping of the support turntable generates a shock to the machine which increases the amount of maintenance needed for the machine and reduces the life of the machine. Other problems that result from the use of such a rapid stopping mechanism will be apparent from the discussion of the advantages of the present invention as set forth further below.

While variable speed drive mechanisms have been extensively employed, such as in those patents noted above, such drive mechanisms have not been used so as to reduce the speed of the support turntable in a stretchable wrapping machine during a short time period immediately prior to stopping the rotation of the support turntable so as to provide a gradual stopping or soft-stop of the support turntable. Other patents that illustrate variable speed drive mechanisms for varying the speed of operation of rotating a support during a winding or unwinding operation are illustrated in U.S. Pat. Nos. 3,977,621 to Huffman, 4,003,525 to Podvin et al. and 4,103,840 to Dowd. In each of these machines, the variable speed drive that may include the utilization of a braking mechanism are used for insuring that a constant tension is maintained on the material being either wound or unwound from a dispensing mechanism and so as to prevent spillage of the material from the dispensing mechanism. None of these patents, however, provide any disclosure of a stretch wrapping machine that is either concerned with or solves those problems previously discussed above that occur in the termination of the wrapping operation in a stretch wrapping machine as previously discussed above.

SUMMARY OF THE INVENTION

An object of the present invention is to provide an improved stretch wrapping machine.

Another object of the present invention is to provide an improved stretch wrapping machine that avoids those problems discussed above that are inherent in the operation of prior stretch wrapping machines A further object of the present invention is to provide a stretch wrapping machine with a gradual soft-stop capability.

Still another object of the present invention is to provide a stretch wrapping machine in which the support turntable is rotated at a first speed during the majority of the stretch wrapping operation and at a second slower speed during a portion of the last revolution of the stretch wrapping operation.

Still a further object of the present invention is to provide an improved stretch wrapping machine that employs a control mechanism for controlling the rotational movement of the support turntable so that such turntable rotates a preselected number of revolutions and during a portion of the last revolution of such support turntable the turntable is rotated at a second slower speed with the minimum duration of such portion of the last revolution being selected in dependence upon the weight of the load being wrapped.

A still further object of the present invention is to provide an improved stretch wrapping machine in which the turntable stops at exactly the same place every time regardless of the load on the turntable, the braking action of the turntable is extremely gentle on the load, the gentle stopping of the rotational movement of the turntable enables unstable or delicate loads to be more rapidly wrapped, gentle stopping of the rotational movement of the turntable reduces shock to the wrapping machine thereby reducing the required maintenance and extending the life of the machine, and any tendency of the support turntable to overshoot the desired stopping location is minimized thereby avoiding any loosening of the wrapped stretchable material.

The wrapping machine of the present invention which is capable of achieving all of the above objectives enables a load that is supported on a rotatable support turntable to be wrapped in a unitary package. The stretchable wrapping material used for wrapping the load is held by a dispenser. A driving mechanism rotatably drives the support turntable so as to create relative movement between the support turntable and the dispenser. The leading edge of the stretchable material is attached to the load, which can be done by tucking in a portion of the leading edge into a space in the load so that as the support turntable is rotated stretchable material is withdrawn from the dispenser. A control mechanism controls the operation of the drive mechanism so as to enable the support turntable to be rotated a plurality of turns for wrapping the load with the stretchable material. The control mechanism causes the support turntable to be rotated at a first speed during a first portion of the rotatable movement of the support turntable and at a slower speed during a second subsequent portion of the rotatable movement of the support turntable. The duration of the second portion of the rotatable movement is a portion of the last revolution of the support turntable. The minimum duration of this second period of rotation is selected in dependence upon the weight of the load being wrapped with larger loads that would have a greater momentum during rotation requiring a longer period for slowing down the rotational movement.

During the operation of the stretch wrapper of the present invention, the turntable on which the load is placed is rotated at a speed normally between 2 and 10 rpm. By utilizing a variable speed DC motor drive in conjunction with an electronic control mechanism, the speed of the turntable can be infinitely varied. It is typical in the operation of such stretch wrappers to have a gradual start-up and acceleration of the DC motor so that the speed is increased to the operating speed over a period of perhaps 3 seconds. Such a gradual start-up is referred to as a "soft-start" feature. In the operation of this stretch wrapper of the present invention, a "soft-stop" feature is also included. As the machine completes the wrapping operation and as the turntable is making the last revolution, during a portion of such last revolution, e.g. the last third of such revolution, the speed of the turntable is decreased by causing the motor to operate at a slower speed. In order to switch the motor to the slower speed for slowing down the rotational movement of the turntable, a cam is provided on the turntable that actuates a limit switch. Actuation of the limit switch causes the turntable speed to be reduced from whatever speed it was set at to approximately 1 to 2 rpm. When the turntable reaches the actual position at which it is to be stopped, the cam on the bottom of the turntable actuates a second limit switch which stops the motor and brakes the rotation of the turntable by shorting out the motor and causing it to act as a generator through a resistor.

While the limit switches that are provided under the turntable will be tripped by the cam on the bottom of the turntable during each revolution of the turntable, the control mechanism is constructed in such a manner so as to prevent the drive motor to switch to the second slower speed until the turntable is on its last revolution. For this purpose, the control mechanism includes appropriate timing circuits that prevent premature actuation of the switches for decreasing the speed of the motor. As an example, if the turntable speed is set at 10 rpm, which equals 6 seconds per revolution, and 3 revolutions (3 wraps) are desired, the timer circuit is set so as to allow the limit switches to cause the variable speed motor to drop to a slower speed at a time of more than 10 seconds but less than 16 seconds after initiation of the wrapping operation. These time periods take into consideration the situation where the first limit switch is set 120° from the stopping point for the turntable. This angle of 120° was selected when operating the wrapper for wrapping a 9000 lb. load. Thus, the 10 seconds allows the cam to travel past the location of the limit switch for decreasing the speed of rotation when the turntable is on its second revolution and the 16 seconds is the time that it should take for the cam to contact the same limit switch during the third rotation. In this manner, it is assured that there will be at least two revolutions but not four revolutions of the turntable.

In another exemplary embodiment of the present invention, in a spiral wrapping machine where the number of revolutions was to exceed 10 revolutions a higher speed of 24 rpm was used. With this higher speed the greater momentum of the rotating load necessitates a longer stopping period. Hence the slow down period was commenced 300° from the stopping position, where the load was approximately 2000 lbs.

If the speed of rotation, the number of revolutions of the turntable and the weight of the load are all extremely high then in such unusual circumstances it may be necessary to commence the second slower speed during the next to last revolution.

The control mechanism of the present invention can be used in any type of stretch wrapping machine including a wide web stretch wrapper, a spiral stretch wrapper and a dual roll stretch wrapper.

The stretch wrapper of the present invention can also be arranged at a location along a conveyor system. Such an arrangement is shown in co-pending patent application Ser. No. 72,471 filed Sept. 4, 1979, which is entitled WRAPPING APPARATUS AND METHOD, now U.S. Pat. No. 4,299,076 and assigned to the same assignee as the present application. The subject matter of said co-pending application is hereby incorporated by reference.

DESCRIPTION OF THE PREFERRED EMBODIMENTS

Figure 1:
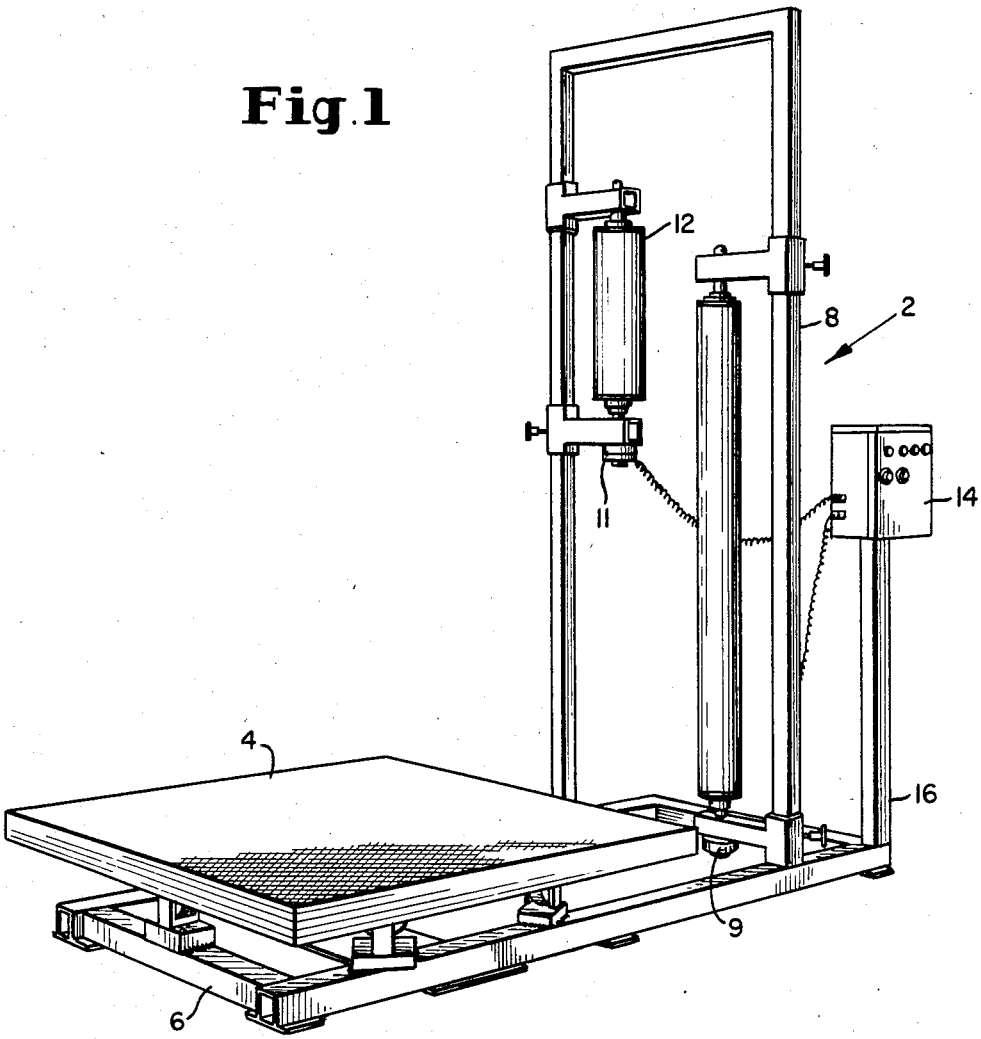
FIG. 1 is a perspective view of a stretch wrapping machine that can be utilized in accordance with the present invention.

A dual roll stretch wrapping machine 2 is illustrated in FIG. 1. While a dual roll wrapper has been shown, it is also possible to use other types of stretch wrapping machines such as a single roll wrapping machine and a spiral wrapping machine. In a single roll wrapping machine 1, a rolled up web of stretchable wrapping material is used with the width of the web being wide enough to cover the entire load. In a spiral wrapping machine the width of the rolled up web is much smaller than the height of the load to be wrapped but during the wrapping operation as the load is rotated the roll of wrapping material is moved up and down a vertical path so that the material will cover the entire height of the load.

Stretch wrapper 2 includes a turntable 4 that is mounted so as to be capable of being rotated relative to base support 6 of the machine. Two rolls of a stretchable web of wrapping material 10 and 12 are supported by brackets mounted on the dispenser support frame 8. The control mechanism for stretch wrapper 2 is contained within control circuit 14 that is arranged on post 16.

Control circuit 14 is electrically coupled to a drive motor mounted on frame 6 at a location under turntable 4 for rotating a turntable as well as being connected to brake mechanisms 9 and 11 that are connected to the supports for rolls 10 and 12 of the stretchable material. Brake mechanisms 9 and 11 can be used for insuring that a proper tension is applied to the web of stretchable material withdrawn from rolls 10 and 12 during a wrapping operation. Further, control circuit 14 is also coupled to limit switches that are arranged under turntable 4 for being actuated by a cam on the turntable.

Figure 2:
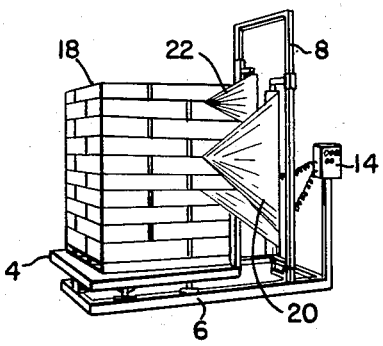
FIG. 2 is another view of the stretch wrapper of FIG. 1 with a load being arranged on the turntable and operation of the machine just being initiated.
Figure 3:
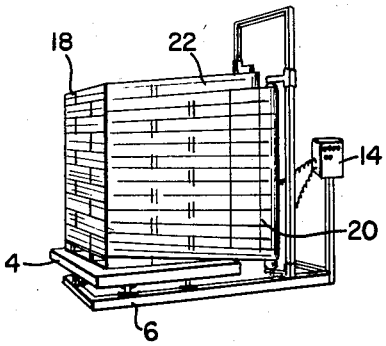
FIG. 3 is a view similar to FIG. 2 after at least one revolution of the turntable in the wrapping operation has occurred.

In initiating a wrapping operation, a load 18 is positioned on top of turntable 4 such as shown in FIG. 2. The leading edges of wrapping materials 20 and 22 from rolls 10 and 12, respectively, are tucked in between portions of the load such as shown in FIG. 2. If the load is formed by a plurality of boxes then these leading edges of the wrapping materials are tucked in between the boxes. After the wrapping materials are attached to the load, rotation of turntable 4 is initiated. Since the wrapping materials are not firmly secured to the load, normally at least the first quarter revolution of the turntable is carried out at a slower speed with the speed gradually increasing to the desired level. After the turntable has been partially turned so that the load is at least partially wrapped the stretchable material will be more firmly secured to the load thereby allowing the turntable to be rotated at the full speed that has been preselected. In FIG. 3, the load is shown after it has been partially wrapped.

The width of the rolls 10 and 12 of stretchable material are selected so that they will fully cover the entire height of the load with a portion of the two materials overlapping each other. Thus as seen in FIG. 3 the entire height of the load is covered with the stretchable wrapping materials.

After turntable 4 has been rotated a preselected number of revolutions for wrapping load 18 with the stretchable wrapping material, during a portion of the last revolution the speed of rotation of turntable 4 is decreased to a second slower speed. Thus, while the turntable may be rotated at a first, higher speed, such as, for example, 2 to 10 rpm during the first period of rotation of the turntable, during a portion of the last revolution, a second time period, the speed of rotation is dropped to a speed of approximately 1 to 2 rpm. The desired duration of this second time period is dependent upon the weight of the load being wrapped and the speed of rotation during the first time period. The greater the weight of the load the greater the momentum and hence the longer the time period needed to slow down the speed of rotation of the load from the first higher speed to the second slower speed before actually stopping rotation of turntable 4.

In order to cause turntable 4 to change to the second, slower speed of rotation, a switching member on the bottom of turntable 4 actuates a limit switch during the last revolution of turntable 4. The limit switch is placed at an appropriate location, i.e. at a preselected angle with respect to the final resting position of turntable 4, for being actuated by an actuating member on turntable 4 as it passes such limit switch. In addition, a second limit switch is arranged under turntable 4 at the final position for stopping of the rotational movement of turntable 4 to actuate an appropriate circuit for stopping the rotation of turntable 4.

Figure 4:
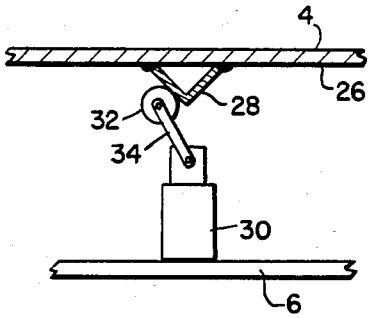
FIG. 4 is a partial side elevational view of the cam on the bottom of the turntable in a position for actuating one of the limit switches.

In order to accomplish the changing in the speed of rotation of turntable 4 and the stopping of turntable 4, a switching cam member 28 is mounted on the bottom 26 of turntable 4 such as shown in FIG. 4. Two limit switches are arranged at appropriate locations under turntable 4 mounted on frame 6. The first limit switch, such as limit switch 30 is arranged on frame 6 at a preselected angle with respect to the final stopping position for turntable 4 so that when actuated it can cause the control circuit of the system to change the speed of rotation of turntable 4 to the second slower speed. As switching cam 28 passes limit switch 30, the cam contacts roller 32 and causes pivoting of switching arm 34. The pivotal movement of switching arm 34 causes actuation of limit switch 30. The same type of limit switch as limit switch 30 is also placed at the location where switching cam 28 should be when turntable 4 reaches its final stopping position. At such position switching cam 28 actuates the limit switch which in turn causes a braking force to be applied to turntable 4. If the momentum of the turntable is significantly high then it is possible to place the limit switch for causing the application of the braking force a slight distance ahead of the position where switching cam 28 should be when turntable 4 comes to its final stopping position.

Actuation of the first limit switch for changing the speed of rotation of the turntable causes the control system to decrease the speed of rotation of the DC motor to drop to its second slower speed of rotation thereby decreasing the speed of rotation of turntable 4. Actuation of the second limit switch causes the control system to change the mode of operation of the DC motor so that the motor in essence acts as a generator thereby placing a dynamic braking force onto turntable 4. When turntable 4 is rotating at the second slower speed, such as on the order of 1 to 2 rpm, the application of such a dynamic braking force easily brings the turntable to a halt at the desired location for stopping the turntable.

Since during each revolution of turntable 4 switching cam 28 will contact rollers 32 and cause pivoting of arm 34 of the limit switches 30, the control circuit is provided with a timing mechanism that prevents the control circuit from prematurely decreasing the speed of operation of the turntable and stopping the rotation of the turntable. For this purpose, it is first determined how many revolutions of turntable 4 should be made before stopping its rotation and in addition what the speed of rotation will be. For explanatory purposes, it will be assumed that in a particular operation three wraps are desired, the speed of rotation during the first time period is set at 10 rpm and in addition that the first limit switch for causing the decrease in the speed of rotation is arranged at an angle of 120° from the final stopping position for turntable 4. Accordingly, each revolution in this wrapping operation takes 6 seconds. A first timer, therefor, is set between 10 and 16 seconds so that actuation of the first limit switch will not have any effect until two wraps of the load have been made and additionally will prevent four wraps from being made. The setting of 10 seconds allows cam 28 to rotate past the first limit switch twice before the control circuit will allow actuation of such limit switch to have any effect on changing the speed of rotation of the turntable. In addition, the setting of this first timer at less than 16 seconds insures that the first limit switch will be actuated during the third revolution of the turntable. Actuation of the second limit switch can be set so as to only occur after the first limit switch has been actuated or can be set up so as to only be actuated after a predetermined time period which can be separately set.

Figure 5:
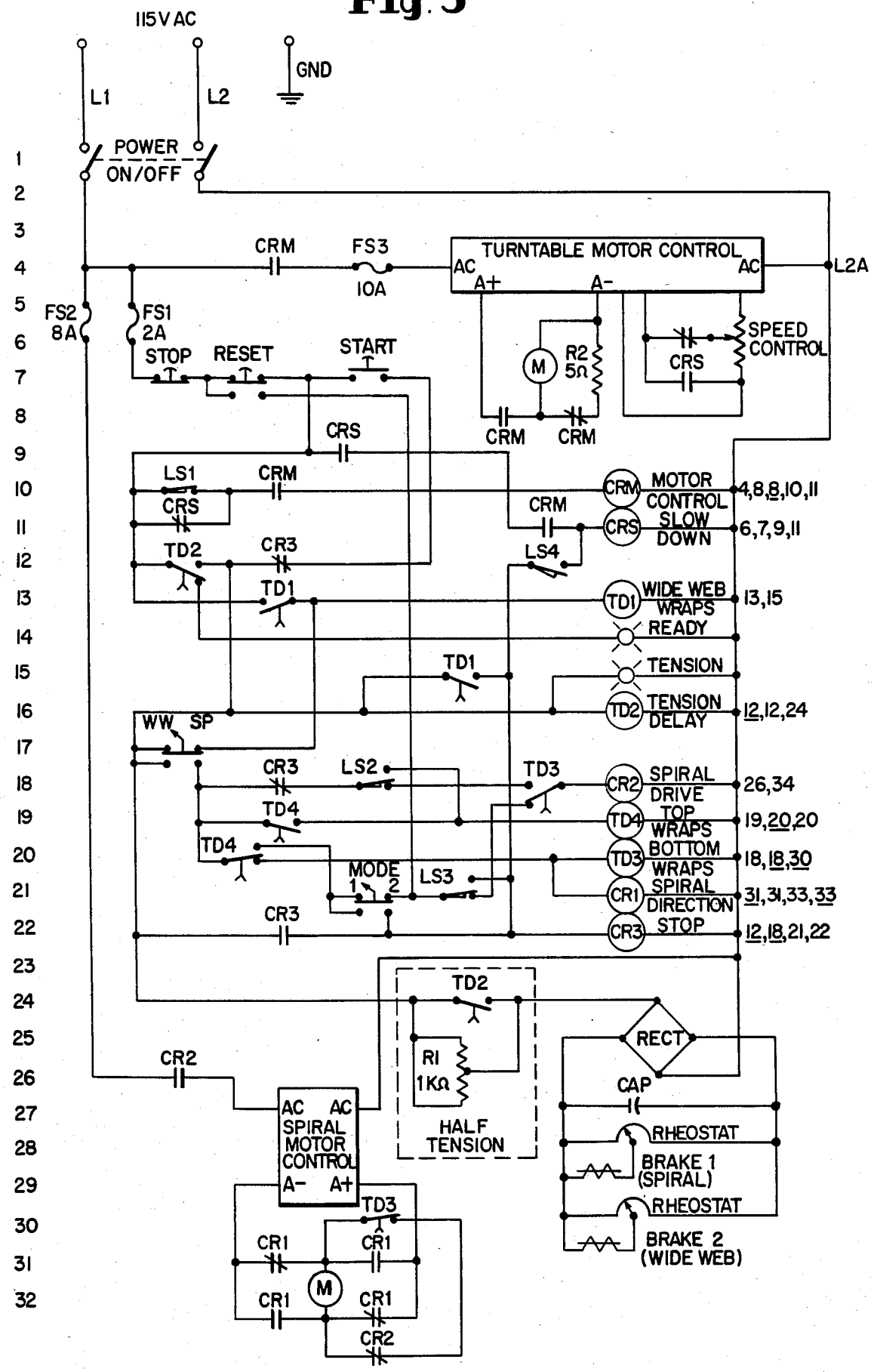
FIG. 5 is a schematic circuit diagram of the control mechanism of the present invention.

The schematic diagram of FIG. 5 is an exemplary electrical circuit diagram that can be utilized in accordance with the present invention. The control circuit illustrated is for a machine capable of carrying out either a wide web or spiral stretch wrapping operation. Thus, by setting the switches, the circuit can be used as either a wide web or a spiral wrapping machine or can be used for wrapping the load with material from two webs such as shown in FIG. 1. For the sake of simplicity, however, the discussion will be limited to a wide web wrapping operation. In this explanation, references to a line number such as "line 3" refers to the circuit diagram line location which is noted along the left hand margin of the circuit.

The device which controls the number of wraps or number of turntable revolutions is timer TD-1. For purposes of this explanation, it is assumed that three wraps are desired and that the machine speed is 10 rpm. With a rotational speed of 6 seconds per revolution, TD-1 must be set somewhere between 10 and 16 seconds. If TD-1 is set less than 10 seconds, only two wraps will result and if TD-1 is set over 16 seconds, 4 wraps will result.

In order to initiate operation of the machine, the operator presses the start button located on line 7 which energizes relay coil CRM on line 10. Energizing relay coil CRM closes normally open contacts on lines 4, 8, 10 and 11 and opens normally closed contacts on line 8. All of the contacts in the drawings are indicated as parallel lines with the letter designations corresponding to the particular relay coil that causes either the opening or the closing of such contacts. Where a line is shown through the parallel lines, this indicates a normally closed contact while without the line the illustration is of a normally open contact. Contacts on line 10 maintain power to relay coil CRM when the start button is released. The contacts on line 4 then supply AC power to the turntable motor control on line 4 and the contacts on line 8 open so as to disconnect braking resistor R2 from the circuit. At the same time, other sets of contacts on line 8 close so as to supply DC power to the motor. Simultaneously AC power is supplied to timer TD-1 on line 13 which begins to count seconds. In addition, AC power is supplied to timer TD-2 on line 16 which also begins to count seconds.

At this point in time, turntable 4 is rotating and initially the tension on the stretchable material is set at half of full tension. The AC power is applied to the rectifier on lines 24/25 through resistor R1 on line 26 and thus DC power is applied to the brake in the half tension system.

When timer TD-2 times out, which is usually at a period set between 2 and 4 seconds which is equal to approximately ½ of a turntable revolution, contacts TD-2 on line 24 close so as to bypass resistor R1 and to apply a full AC voltage to the rectifier and thus full DC voltage to the brake of the half tension system. However, the maximum braking voltage setting is determined by the setting of rheostats on lines 28 and 30.

At this point in time, turntable 4 has rotated approximately ½ of a revolution and the full preset brake tension on the film has been reached. The gradual acceleration or soft-start of the turntable drive is accomplished by the turntable motor control circuit which is sold by Dart Industries under the designation Dart 185.

The wrapping cycle continues until timer TD-1 times out and simultaneously contacts TD-1 on line 13 are closed, which simply keeps the timer coil energized, and also closes contacts TD-1 on line 15. When the turntable is at a location 120° before its stopping or home position, cam 28 on the table actuates limit switch LS-4 on line 12, which applies power to relay CRS. Relay CRS then closes contacts on line 7 and 9 and opens normally closed contacts on lines 6 and 11. The normally closed contacts on line 6 open so as to disconnect one leg of the speed adjusting potentiometer while the normally open contacts on line 7 close so as to connect wire 2D to wire 2G which causes the motor control to slow down to the second slower speed, which is for example, established at 2 rpm.

As the turntable reaches the home position, cam 28 actuates limit switch LS-1 on line 10 so as to deenergize relay CRM on line 10. Deenergizing of relay CRM in turn deenergizes relay CRS on line 11. Relay CRM contacts on line 4 then opens so as to disrupt AC power to the motor control. One set of CRM contacts on line 8 in turn opens to disrupt DC power to the motor while another set of CRM contacts on line 8 close to short the motor connection through resistor R-2. A back voltage from the motor that now acts as a generator against an almost dead short load quickly stops the rotation of the turntable, i.e. dynamically braking the turntable.

The present invention may be embodied in other specific forms without departing from the spirit or essential characteristics thereof. The present embodiments are presented merely as illustrative and not restrictive, with the scope of the invention being indicated by the attached claims rather than the foregoing description. All changes which come within the meaning and range of equivalency of the claims are therefore intended to be embraced therein.

What is claimed is:

1. A wrapping machine for wrapping a load in a unitary package, said wrapping machine comprising:

rotatable support means for supporting a load to be wrapped;

dispensing means for holding a rolled up sheet of stretchable material to be wrapped around a load supported by said support means;

driving means for rotatably driving said support means so as to create relative movement between said support means and said dispensing means, said driving means being capable of driving said support means at either of two different speeds;

control means for controlling the operation of said driving means so as to enable said support means to be rotated a plurality of turns for wrapping a load supported by said support means with material dispensed by said dispensing means, said control means first causing said driving means to rotate said support means at a first speed during a first portion of the rotatable movement of said support means and said control means subsequently causing said driving means to rotate said support means at a second slower during a second, subsequent portion of the rotatable movement of said support means, such second portion being a portion of the last revolution of said support means; and, braking means for braking the motion of said support means only after said support means has been rotated a distance at the second slower speed when said support means reaches its rest position after a desired plurality of revolutions of said support means.

2. A wrapping machine according to claim 1 wherein said control means controls said driving means so as to rotate said support means a preselected number of revolutions and only during a portion of the last revolution of said support means during a wrapping operation to rotate said support means at the second slower speed, with the minimum duration of such portion of the last revolution being selected in dependence upon the weight of the load being wrapped.

3. A wrapping machine according to claim 1 wherein said control means causes said driving means to rotate said support means at the second lower speed during approximately the last 120° of the last revolution of said support means.

4. A wrapping machine according to claim 1, 2 or 3 wherein said driving means includes a variable speed DC motor and said control means causes said driving means to rotate said support means at a speed of between 2 and 10 rpm during the first portion of the rotational movement of said support means and at a speed of approximately 1 to 2 rpm during the second, latter portion of the rotational movement of said support means.

5. A wrapping machine according to claim 4 wherein said braking means includes means for dynamically braking the motion of said support means.

6. A wrapping machine according to claim 4 wherein: said support means includes a switching member protruding therefrom; said control means includes at least one limit switch arranged in a location so as to be capable of being actuated by said switching member, with such location being approximately that position at which the speed of rotation of said support means is to be decreased to its second slower speed; and said control means responding to actuation of said limit switch after said support means has rotated a predetermined number of revolutions so that said control means causes said drive means to rotate at its second slower speed.

7. A wrapping machine according to claim 1, 2 or 3 wherein: said support means includes a switching member protruding therefrom; said control means includes at least one limit switch arranged in a location so as to be capable of being actuated by said switching member, with such location being approximately that position at which the speed of rotation of said support means is to be decreased to its second slower speed; and said control means responding to actuation of said limit switch after said support means has rotated a predetermined number of revolutions so that said control means causes said drive means to rotate at its second slower speed.

8. A wrapping machine according to claim 7 wherein said control means further includes means for dynamically braking the operation of said driving means when said support means reaches its rest position after a desired number of revolutions of said support means.

9. A wrapping machine according to claim 1, 2 or 3 wherein said control means when initiating operation of said drive means causes said drive means to gradually accelerate to its speed for rotating said support means at the first speed of rotation.

10. A wrapping machine according to claim 9 wherein during the period of initiating operation of said drive means, said control means causes a tension to be placed upon the stretchable material of at least 50% of full tension placed upon the stretchable material during the wrapping operation.

11. A wrapping machine according to claim 6 wherein said control means further includes: braking means for dynamically braking the movement of said support means when said support means reaches its rest position after a desired plurality of revolutions of said support means, a second limit switch arranged in a location for being actuated by said switching member of said support means when said support means reaches its rest position after the desired plurality of revolutions, and said second limit switch when actuated in turn actuates said braking means.

12. A wrapping machine according to claim 7 wherein said control means further includes: braking means for dynamically braking the movement of said support means when said support means reaches its rest position after a desired plurality of revolutions of said support means, a second limit switch arranged in a location for being actuated by said switching member of said support means when said support means reaches its rest position after the desired plurality of revolutions, and said second limit switch when actuated in turn actuates said braking means.

13. A wrapping machine for wrapping a load in a unitary package, said wrapping machine comprising:

rotatable support means for supporting a load to be wrapped;

dispensing means for holding a rolled up sheet of stretchable material to be wrapped around a load supported by said support means;

driving means for rotatably driving said support means so as to create relative movement between said support means and said dispening means, said driving means being capable of driving said support means at either of two different speeds;

control means for controlling the operation of said driving means so as to enable said support means to be rotated a plurality of turns for wrapping a load supported by said support means with material dispensed by said dispensing means, said control means first causing said driving means to rotate said support means at a first speed during a first portion of the rotatable movement of said support means and said control means subsequently causing said driving means to rotate said support means at a second slower speed during a second, subsequent portion of the rotatable movement of said support means, with the minimum duration of such portion of the last revolution being selected in dependence upon the weight of the load being wrapped and the first speed of rotation; and, braking means for braking the motion of said support means only after said support means has been rotated a distance at the second slower speed when said support means reaches its rest position after a desired plurality of revolutions of said support means.

14. A wrapping machine according to claim 13 wherein said control means controls said driving means so as to rotate said support means a preselected number of revolutions and only during a portion of the last revolution of said support means during a wrapping operation to rotate said support means at the second slower speed.

15. A wrapping machine according to claim 13 or 14 wherein said control means causes said driving means to rotate said support means at the second lower speed during approximately the last 120° to 300° of the last revolution of said support means.

16. A method for wrapping a load in a unitary package, said process comprising the steps of:

placing a load to be wrapped on a rotatable support member;

mounting a rolled up sheet of stretchable material at a location adjacent to the support member on which a load is to be placed;

attaching a leading edge of the stretchable material from the rolled up sheet against the load to be wrapped;

rotating the rotatable support member with a load by driving the support member by a variable speed motor operating at a first speed so that such load as it is rotated with the support member draws off stretchable material from the rolled up sheet and a major portion of such rotatable movement being at a first higher speed;

subsequently rotating the support member at a second slower speed by driving the support member by the variable speed motor operating at a second slower speed during a portion of the last revolution of the support member prior to terminating the wrapping operation;

terminating the wrapping operation when the support member has reached its desired rest position; and, braking the rotational movement of the support member only after the support means has been rotated a distance at the second slower speed when the support member reaches its rest position after a desired plurality of revolutions of the support member.

17. A method according to claim 16 wherein the minimum size of the portion of the last revolution during which the support member is rotated at the second slower speed is set in dependence upon the weight of the load being wrapped.

18. A method according to claim 16 wherein the support member is rotated at the second slower speed during approximately the last 120° of the last revolution of the support member.

19. A method according to claim 16 wherein the support member is rotated at the second slower speed during approximately the last 120° to 300° of the last revolution of the support member.

20. A method according to claim 16, 17, 18, or 19 wherein the step of braking includes dynamically braking the rotational movement of the support member.

21. A method according to claim 16 or 17 wherein the second slower speed is set in dependent upon the weight of the load being wrapped.

* * * * *

UNITED STATES PATENT AND TRADEMARK OFFICE

CERTIFICATE OF CORRECTION

PATENT NO. : 4,628,667

DATED : December 16, 1986

INVENTOR(S) : John R. HUMPHREY et al.

It is certified that error appears in the above-identified patent and that said Letters Patent are hereby corrected as shown below:

In column 9, line 9, the word --speed-- should appear after "a second slower".

Signed and Sealed this

Eighteenth Day of August, 1987

*Attest:*

DONALD J. QUIGG

*Attesting Officer*

*Commissioner of Patents and Trademarks*